US005385104A

United States Patent [19]

Binner

[11] Patent Number: 5,385,104

[45] Date of Patent: Jan. 31, 1995

[54] METHOD AND APPARATUS FOR INCINERATING DIFFERENT KINDS OF SOLID AND POSSIBLY LIQUID WASTE MATERIAL

[75] Inventor: Siegfried Binner, Hellerup, Denmark

[73] Assignee: Volund Ecology Systems A/S, Brondby, Denmark

[21] Appl. No.: 168,278

[22] Filed: Dec. 15, 1993

Related U.S. Application Data

[63] Continuation of Ser. No. 971,907, Jan. 4, 1993.

[30] Foreign Application Priority Data

Jul. 3, 1990 [DK] Denmark ..... 1600/90

[51] Int. Cl.[6] ..... F23J 3/00

[52] U.S. Cl. ..... 110/246; 110/216; 110/248; 110/259

[58] Field of Search ..... 110/246, 216, 248, 259

[56] References Cited

U.S. PATENT DOCUMENTS 3,808,989 5/1974 Knaak .
4,188,892 2/1980 Kiefer et al. .
4,299,611 11/1981 Penberthy .
4,915,039 4/1990 Ringel ..... 110/216
4,947,804 8/1990 Abdulally ..... 110/216

FOREIGN PATENT DOCUMENTS 0068319 1/1983 European Pat. Off. .
0330872 9/1989 European Pat. Off. .
9002910 3/1990 WIPO .

*Primary Examiner*—Henry C. Yuen
*Attorney, Agent, or Firm*—Ladas & Parry

[57] ABSTRACT

Waste material is incinerated by a partial combustion in a furnace on step grates and the heated combusted product is supplied in a rotary kiln in which the waste is liquified. Solid waste material passing through the grate is collected with ash products, separated from flue gases, including boiler ash, fly ash and residue from flue gas cleaning. The collected products are returned to the inlet of the rotary kiln where these products are introduced along with he combusted waste. In this manner, the slag, boiler ash, flue ash and other harmful residual products from the combustion process are fused into the liquified waste to form a glass-like mass from which salts and heavy metal cannot be leached out.

14 Claims, 3 Drawing Sheets

METHOD AND APPARATUS FOR INCINERATING DIFFERENT KINDS OF SOLID AND POSSIBLY LIQUID WASTE MATERIAL

This is a continuation of copending application Ser. No. 07/971,907 filed on Jan. 4, 1993 and International Application PCT/DK91/00169 filed on Jun. 21, 1991 and which designated the U.S.

TECHNICAL FIELD

The present invention relates to a method and apparatus for incinerating different kinds of waste.

BACKGROUND ART

With the steadily increasing quantities of waste material and the increasingly strict environmental requirements for the incineration of this material, the use of flue-gas cleaning results in the production of increasingly greater quantities of harmful residual products.

U.S. Pat. No. 3,808,989 describes a method of incinerating solid and possibly liquid waste material in a plant, in which a rotary kiln is being used, said kiln being situated downstream from an incinerating section with stepped grates, the solid waste material being partially combusted on the stepped grates and delivered to the rotary kiln and any liquid waste material being added to the waste material being combusted on the stepped grates. The waste material comprises household refuse and partly dewatered sewage sludge and it is for the ability of the plant to combust sewage sludge clumps essential that solid bodies like stone, glass etc. function like balls in a ball mill, breaking up the sewage sludge clumps, whereby a faster and better burning of these is made possible. There is no mention of melting the slag in the rotary kiln which would also make the essential "milling effect" disappear.

In the waste incineration plants known at the present moment, the temperature of combustion is held below 1100° C., e.g. at approximately 875° C., in order to avoid the formation of liquid slag at the side walls of the grate section and in the rotary kiln, this slag having a tendency to solidify at the sides of the furnace and obstruct the exit end of the rotary kiln.

These plants are so adapted and designed that the slag and the ash are discharged as a dry or moistened non-homogenous mixture respectively in as many as three different discharge assemblies.

Thus, boiler ash is obtained from the boiler assembly, e.g. being of the impact-descaling type, and fly ash from an electrical filter. Further, flue-gas cleaning is performed by adding e.g. lime, after which the flue gas passes through a filter or a flue-gas washing arrangement, in which a residual product is separated.

Further, "small waste" falls through the grate, and such grate screenings are taken to a slag outlet. It is however, necessary that less than 3% of the slag is un-combusted.

These known plants do, of course, suffer from the disadvantages that the salts and heavy metals attached to the slag, the fly ash and the residual products from the flue-gas washing apparatus may be leached out, and some heavy metals evaporate during the process.

For this reason, these products must be deposited in a safe manner, e.g. by being placed in controlled waste-disposal sites, thus producing a percolate of a kind causing considerable damage to the environment, or in salt mines.

DISCLOSURE OF THE INVENTION

It is the object of the present invention to make the slag, fly-ash and other harmful residual products produced by the combustion of solid and/or liquid waste material harmless, and this object is achieved with a method according to the present invention in which the waste is combusted in the grate furnace and is supplied to a rotary kiln along with recycled ash products, the combusted waste being supplied to the kiln at a relatively high temperature to be melted upon entry into the kiln and combined with the recycled ash product.

In this manner, it is achieved that the substances are encapsulated in the relatively hot, liquid slag when passing through the rotary kiln, so that the product from the incineration of the waste material becomes a harmless, glassified slag incapable of giving off harmful substances, such as heavy metals, for which reason this slag may be deposited without problems.

This incineration of waste material can be carried out in a plant, in which various types of waste material being fed in, possibly through a number of feeding arrangements, are dried, ignited, and combusted. The solid waste material is burnt to form a not completely burnt-out slag, the latter being supplied a rotary kiln in direct-line communication with the grate section, in which rotary kiln this slag mixture and the separately fed residual products from the flue-gas cleaning arrangement etc. are fused together so as to form a glass-like mass. The rotation of the rotary kiln enhances the burning-out and fusing of the mass to form a homogenous substance. The waste is heated in the rotary kiln at a temperature of 1100° or higher so that the slag does not solidify in the rotary kiln. Heat is supplied at the exit end of the rotary kiln which makes it possible, if necessary, to ensure maintaining such a high temperature, that the slag does not solidify in the rotary kiln. Thereby, temperature variations due to variations in the calorific value of the waste material are reduced, and a continuous supply of molten material is ensured.

The present invention also relates to an apparatus for use in carrying out the method, said apparatus comprising a grate section and a rotary kiln. A collecting container is situated upstream of the feed assembly which has the advantage that the least possible amount of air is added, at the same time the oxygen supplied to the combustion process is utilized to a maximum extent. The atmosphere produced in this manner, partly having reducing properties, lowers the melting point for various materials without the need of adding reducing agents.

The rotary kiln has restricted end portions so that the liquid slag remains in a pocket at the lowermost part of the rotary kiln, until it has been completely glassified.

BRIEF DESCRIPTION OF THE DRAWINGS

In the following specification, the present invention will be described in more detail with reference To the drawings, in which FIG. 1 diagrammatically shows, in block form, the principle of operation of the apparatus according to the present invention.

DESCRIPTION OF THE PREFERRED EMBODIMENT

Figure 1:
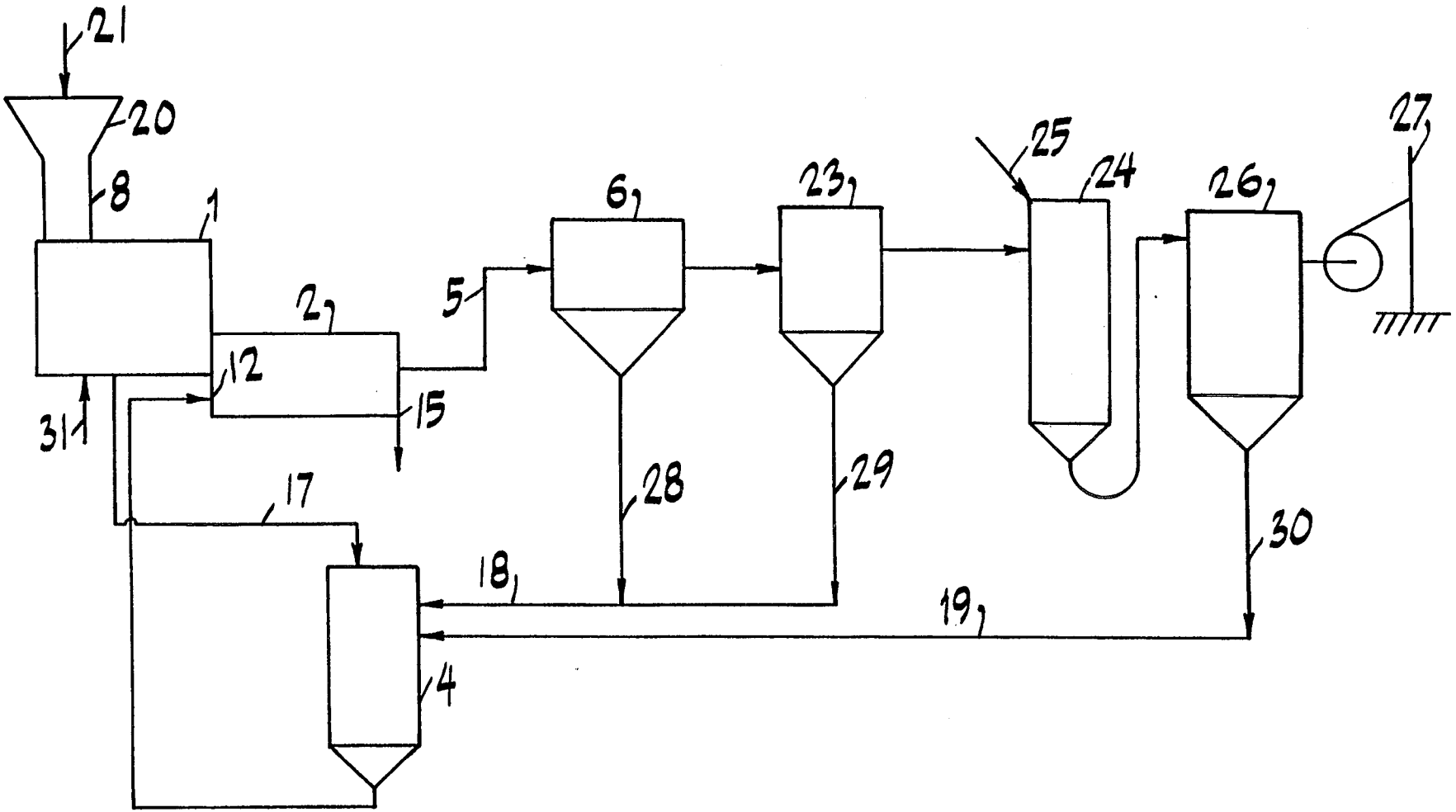
Figure 2:
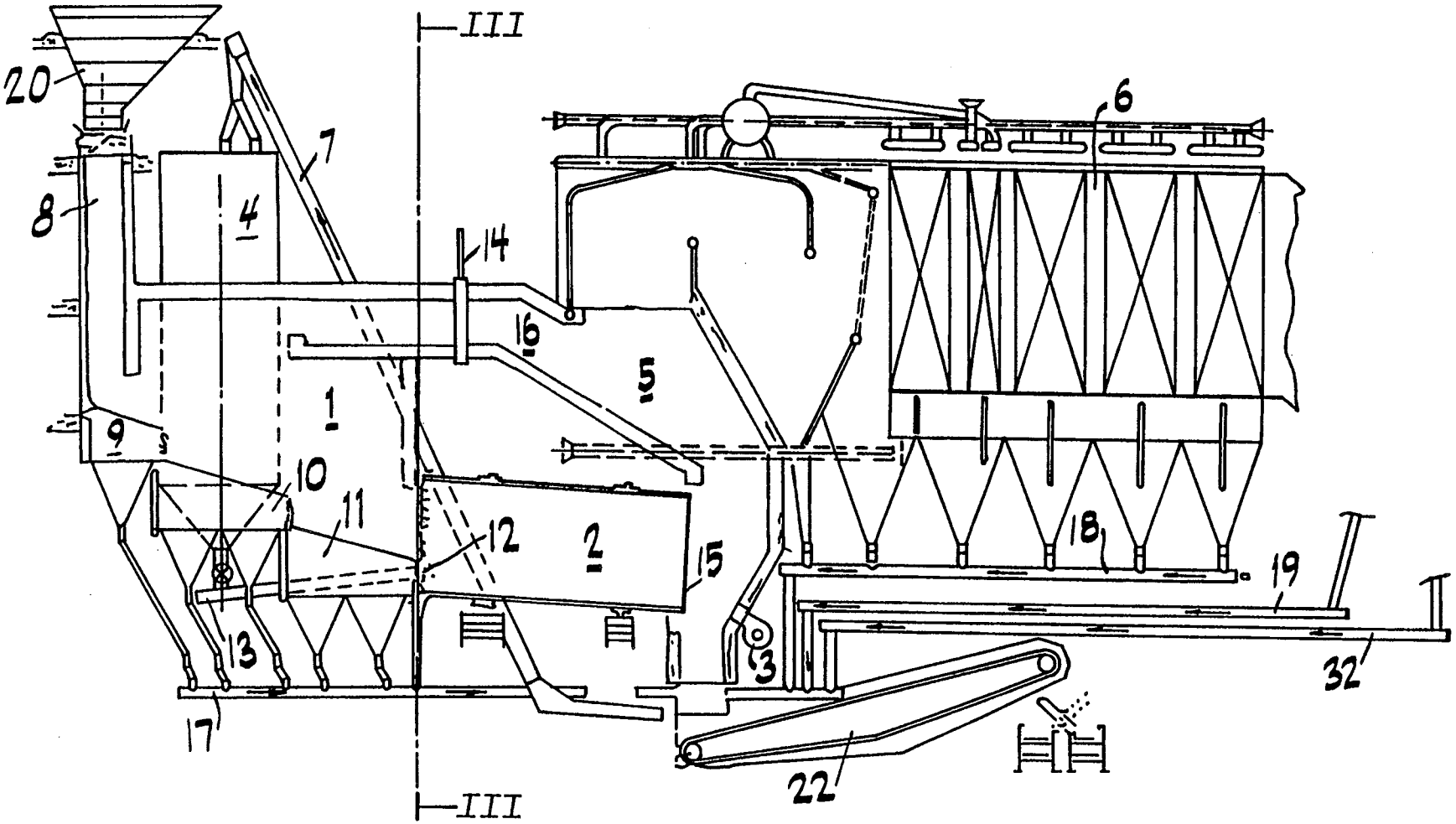
FIG. 2 is a diagrammatical sectional view through an apparatus constructed according to the present invention.
Figure 3:
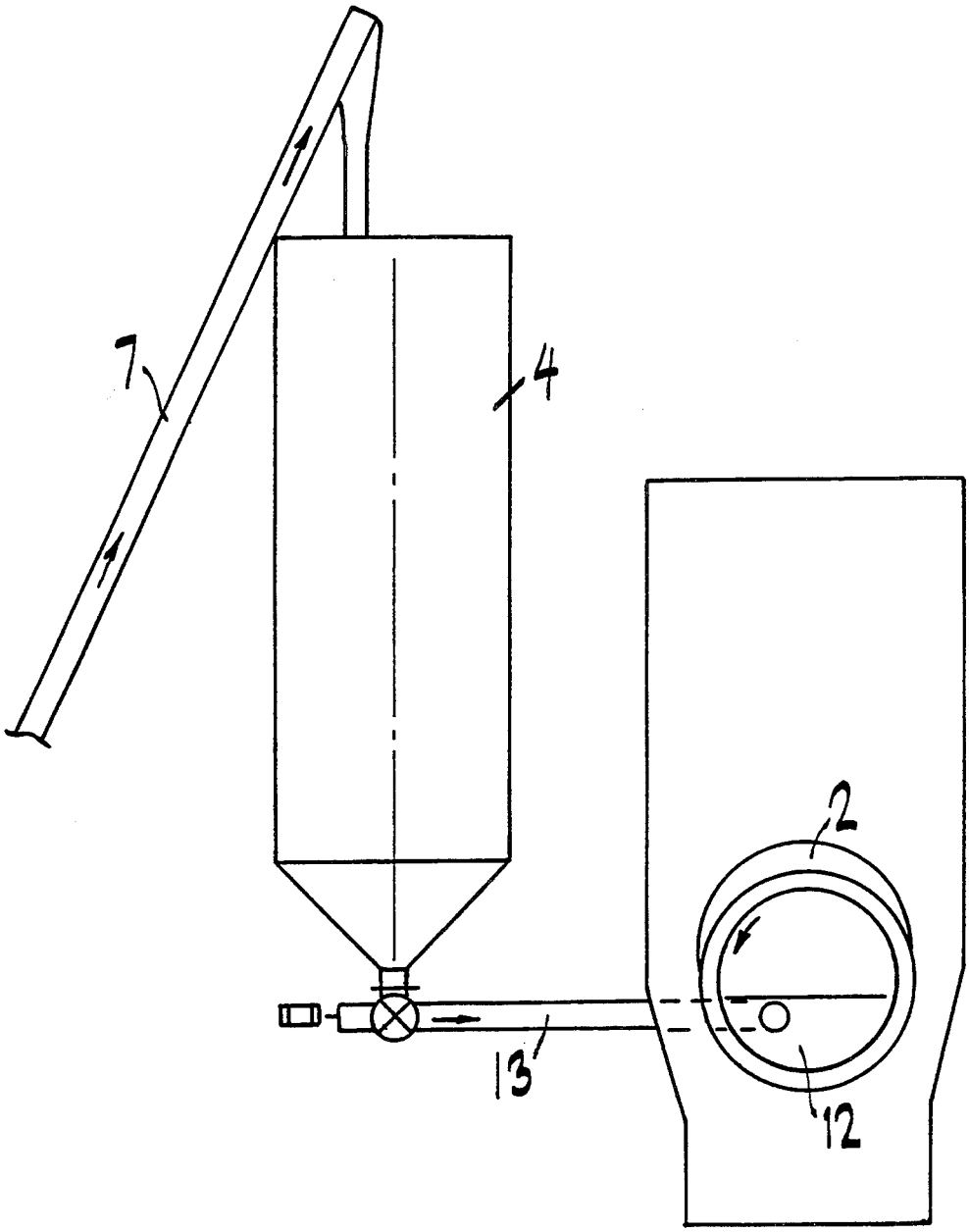
FIG. 3 is a sectional view along the line III—III in FIG. 2, showing the feeding-in of the residual products.

The plant shown in FIG. 2 comprises a grate section 1, a rotary kiln 2, a burner assembly 3, a residual-product silo 4, an after-burning chamber 5, a boiler assembly 6, and a residual-product conveyor 7.

Waste material 21 to be burnt, mainly consisting of household refuse, bark, industrial waste, hospital refuse, and in part chemical waste material in a relatively non-homogenous mixture, is supplied to the plant through a hopper 20 and a feed chute 8 shown to the left in FIG. 2.

The material having been fed in is distributed on grates 9, 10 and 11, these grates also receiving any liquid waste material, and air 31 for combustion is supplied from below.

Grate screenings, i.e. small pieces of waste material, possibly containing unburnt material and having fallen through the grates 9, 10 and 11, are conveyed to the residual-products silo 4 by a belt conveyor 17 and the conveyor 7.

The incompletely burnt slag formed during the burning in the furnace 1 is discharged in a manner known per se into the rotary kiln 2. At the transition 12 from the furnace 1 to the rotary kiln 2, the residual products collected in the intermediate silo 4 are fed in through a worm conveyor 13, and the residual products are mixed with each other and heated to form a molten mass in the rotary kiln 2.

The rotary kiln 2 may have conically converging ends, thus ensuring that the liquid slag is retained.

At the exit end 15 of the rotary kiln 2, the burner assembly 3 is placed, preferably in the form of an oxygen/gas-burner system, adapted to provide continous temperature control at the slag outlet. The slag is removed from the slag outlet 15 by means of a belt conveyor 22.

The flue gases are conducted from the rotary kiln 2 through the after-burning chamber 5 to the boiler assembly 6. In the latter, boiler ash 28 is separated in a tail-end boiler (impact descaling boiler), and fly ash 29 is separated by means of an electrical filter 23. The boiler ash 28 and the fly ash 29 are conveyed to the residual-products silo 4 by means of a belt conveyor 18 and the conveyor 7.

Downstream of the electrical filter 23, the flue gases pass into the reactor 24 in a flue-gas cleaning plant, in which lime 25 is added. The reaction products from this plant are conveyed to a filter 26, in which a residual product 30 is separated. This residual product 30 is conveyed by belt conveyors 19 and 32 to the conveyor 7 and further to the residual-products silo 4, whilst the flue gases, from which the residual product 30 has been removed, are discharged through a chimney 27.

The present invention is not limited to exactly what has here been shown and described, and it should be noted that for a skilled person, it will be possible to make a number of modifications, e.g. by providing a number of rotary kilns or incinerating grates. As mentioned above, the main principle of the invention consists in that combustion slag and residual products, such as grate screenings, fly ash and reaction products, are melted together in a process step without intermediate cooling, i.e. the energy once having been produced in the slag is utilized for the melting process.

| LIST OF PARTS | |
|---|---|
| 1 | grate section |
| 2 | rotary kiln |
| 3 | burner assembly |
| 4 | residual-products silo/intermediate silo |
| 5 | after-burning chamber |
| 6 | boiler assembly |
| 7 | residual-products conveyor |
| 8 | feed chute |
| 9 | grate } stepped grates |
| 10 | grate } stepped grates |
| 11 | grate } stepped grates |
| 12 | transition |
| 13 | dosing worm conveyor |
| 14 | damper |
| 15 | exit end/slag outlet |
| 16 | bypass duct |
| 17 | belt conveyor |
| 18 | belt conveyor |
| 19 | belt conveyor |
| 20 | hopper |
| 21 | waste material |
| 22 | belt conveyor |
| 23 | electrical filter |
| 24 | reactor |
| 25 | lime |
| 26 | filter |
| 27 | chimney |
| 28 | boiler ash |
| 29 | fly ash |
| 30 | residual product |
| 31 | air for combustion |
| 32 | belt conveyor |

It is claimed:

1. An apparatus for incinerating waste comprising:

a furnace having a grate, means for supplying waste products onto the grate in said furnace, means for heating the waste products in said furnace to partially combust said waste products, a rotary kiln having an inlet for receiving the partially combusted waste products from said furnace, means for heating said kiln by further combusting the waste products in said rotary kiln and produce a liquid slag, a collector connected to said furnace to receive therefrom waste products passing through said grate, means for supplying to said collector ash products separated from flue gases produced during combustion of the waste products, and means for conveying the products collected in said collector to the inlet of said rotary kiln to encapsulated and fuse said products in the liquid slag to form a glass-like product at an outlet end of the rotary kiln.

2. Apparatus as claimed in claim 1, comprising a burner assembly at said outlet end of said rotary kiln.

3. Apparatus as claimed in claim 2, wherein said burner assembly comprises an oxygen gas burner.

4. Apparatus as claimed in claim 1, comprising a boiler assembly connected to said kiln for receiving flue gases from the combustion of the waste products for separating ash from the flue gases and filter means connected to said boiler assembly for filtering further ash products contained in the flue gases, said means which supplies said collector with ash products comprising conveyor means connecting said boiler assembly and filter means to said collector.

5. Apparatus as claimed in claim 1, wherein said rotary kiln has an axis of rotation which is inclined downwardly from its inlet end towards its outlet end.

6. A method as claimed in claim 1, wherein said rotary kiln has constricted end portions at said inlet and outlet ends.

7. A method of incinerating waste comprising:

passing solid waste on grates in a furnace, partially combusting said solid waste on said grates to form a slag, conveying the slag of partially combusted waste from the grates to a rotary kiln, further combusting the waste in said rotary kiln to produce heat to liquefy said slag in the kiln, delivering the waste to said rotary kiln at a sufficiently high temperature that the heating thereof in the kiln by the further combustion of the waste will liquefy the slag in the kiln and maintain the slag in liquid state therein, separating ash products from flue gases produced in the rotary kiln from the combustion of the waste therein, collecting residual products, including waste which has passed through said grates and said ash products which are separated from said flue gases from the combustion of the waste, and returning the thus collected residual products to an inlet of the rotary kiln together with the slag from the grates of the furnace so that said residual products are encapsulated by and fused together with the liquified slag in the rotary kiln to form a glass-like product.

8. A method as claimed in claim 7, comprising rotating said kiln to make the glass-like product homogeneous.

9. A method as claimed in claim 7, comprising effecting heating of the waste in the kiln to a temperature of at least 1100° C.

10. A method as claimed in claim 7, comprising controlling the temperature in said furnace by selectively opening and closing a damper in a bypass duct between a flue gas duct from the kiln and said furnace.

11. A method as claimed in claim 7, comprising utilizing energy in said waste to effect the melting thereof in said kiln.

12. A method as claimed in claim 7, comprising heating the product in the rotary kiln upon its exit therefrom.

13. A method as claimed in claim 7, comprising effecting the separating of said ash products in a boiler and a filter.

14. A method as claimed in claim 13, comprising conveying the flue gases, after separation of the ash products, to a reactor and a further filter to separate further solids and conveying the latter solids to the inlet of the rotary kiln together with the other collected residual products.

* * * * *